US009080799B2

(12) United States Patent
Hong et al.

(10) Patent No.: US 9,080,799 B2
(45) Date of Patent: Jul. 14, 2015

(54) REFRIGERATOR

(71) Applicant: SAMSUNG ELECTRONICS CO., LTD., Suwon-si, Gyeonggi-do (KR)

(72) Inventors: Chang Uo Hong, Hwaseong-si (KR); Young Il Song, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 249 days.

(21) Appl. No.: 13/724,766

(22) Filed: Dec. 21, 2012

(65) Prior Publication Data

US 2013/0167575 A1 Jul. 4, 2013

(30) Foreign Application Priority Data

Dec. 30, 2011 (KR) ..... 10-2011-0147529

(51) Int. Cl.
*F25C 1/00* (2006.01)
*F25C 5/18* (2006.01)
*F25C 5/00* (2006.01)

(52) U.S. Cl.
CPC . *F25C 1/00* (2013.01); *F25C 5/005* (2013.01); *F25C 5/182* (2013.01); *F25C 2305/022* (2013.01)

(58) Field of Classification Search
CPC ..... F25C 5/182; F25C 1/24; F25C 5/16; F25C 5/046; F25C 1/04; F25C 1/00; F25C 2305/022; F25D 23/087
USPC ..... 62/344, 381, 382, 302, 354, 129, 320, 62/340
See application file for complete search history.

(56) References Cited

U.S. PATENT DOCUMENTS

| | | | | |
|---|---|---|---|---|
| 3,403,570 | A * | 10/1968 | Larson et al. | 74/411.5 |
| 3,580,007 | A * | 5/1971 | Bauerlein | 62/345 |
| 3,937,032 | A * | 2/1976 | Bright | 62/135 |
| 4,800,731 | A * | 1/1989 | Cole | 62/233 |
| 4,909,039 | A * | 3/1990 | Yamada et al. | 62/66 |
| 2004/0099076 | A1* | 5/2004 | Haskin et al. | 74/425 |
| 2004/0163405 | A1* | 8/2004 | Jung | 62/344 |
| 2005/0072167 | A1* | 4/2005 | Oh | 62/137 |
| 2008/0034779 | A1* | 2/2008 | Lee et al. | 62/344 |

(Continued)

FOREIGN PATENT DOCUMENTS

| | | |
|---|---|---|
| DE | 10 2009 027 945 | 1/2011 |
| EP | 2 151 644 | 2/2010 |

(Continued)

OTHER PUBLICATIONS

Translation of JP 2011069590 to Hashimoto, Masako.*

(Continued)

*Primary Examiner* — Mohammad M Ali
(74) *Attorney, Agent, or Firm* — Staas & Halsey LLP

(57) ABSTRACT

A structure of a driving apparatus capable of easily organizing a driving apparatus that is configured to drive an ejector of an ice maker, and preventing frost from being formed on inner compartments, the driving apparatus including a case and a driving module detachable to the inner side of the case, wherein the driving module includes an ice separating motor to drive the ejector, a circuit board to control an ice making process, an electro-motion member to deliver a rotational force of the ice separating motor to the ejector, and a module case to accommodate the components of the driving module.

14 Claims, 16 Drawing Sheets

(56) References Cited

U.S. PATENT DOCUMENTS

| | | | | |
|---|---|---|---|---|
| 2008/0156022 | A1* | 7/2008 | LeClear et al. | 62/344 |
| 2010/0212340 | A1* | 8/2010 | Kuratani | 62/137 |
| 2010/0218524 | A1* | 9/2010 | Saito | 62/135 |
| 2010/0319385 | A1* | 12/2010 | Hashimoto | 62/344 |
| 2011/0023510 | A1* | 2/2011 | Lee | 62/137 |
| 2011/0259037 | A1* | 10/2011 | McCollough et al. | 62/345 |

FOREIGN PATENT DOCUMENTS

| | | |
|---|---|---|
| JP | 2011-69590 | 4/2011 |
| KR | 10-0814686 | 3/2008 |
| KR | 10-2009-0079044 | 7/2009 |
| KR | 10-2009-0079377 | 7/2009 |
| WO | WO 2011/105791 | 9/2011 |

OTHER PUBLICATIONS

European Search Report issued Nov. 19, 2014 in correspionding European Application No. 12199441.2.

* cited by examiner

REFRIGERATOR

CROSS-REFERENCE TO RELATED APPLICATIONS

This application claims the benefit of Korean Patent Application No. 10-2011-0147529, filed on Dec. 30, 2011 in the Korean Intellectual Property Office, the disclosure of which is incorporated herein by reference.

BACKGROUND

1. Field

Embodiments of the present disclosure relate to a refrigerator having a direct-cooling type ice maker directly contacted by a refrigerant pipe.

2. Description of the Related Art

In general, a refrigerator is an apparatus configured to store foods fresh by having a storage compartment capable of storing foods and a cooling air supplying apparatus capable of supplying a cool air to the storage compartment. A refrigerator may be provided with an ice maker capable of generating ice.

As for the methods of cooling an ice maker, an indirect-cooling type is configured to cool an ice maker by guiding a cool air which is generated at an evaporator at an outside an ice making compartment through a transport duct to the ice making compartment, and a direct-cooling type is configured in a way to directly cool an ice maker with a cool air at an inside an ice making compartment by additionally installing a heat exchanger at an inside of the ice making compartment.

In particular, as one of the direct-cooling methods, a refrigerant pipe is configured to make direct contact with an ice making tray of an ice maker so that the ice making tray may serve as a heat exchanger without having a separate heat exchanger.

The ice making method using the direct-cooling type ice maker, which is configured to serve as a heat exchanger by having a refrigerant pipe directly contacted to the ice maker, may perform a cooling at a faster speed than other ice making methods. However, a process in disposing and fixing a portion of the refrigerant pipe at an inside an ice making compartment in order for the refrigerant pipe to make contact with an ice making tray is needed, and frost may frequently form as a result of the difference in temperature at an inside the ice making compartment.

SUMMARY

Therefore, it is an aspect of the present disclosure to provide a structure of a driving apparatus having an ice separating motor configured to drive an ejector of an ice maker and electro-motion members configured to control an ice making process, and having an improved assembly quality.

It is another aspect of the present disclosure to provide a structure of a driving apparatus configured to prevent frost from forming on an ice separating motor and electro-motion members, thereby preventing the ice separating motor and the electro-motion member from malfunctioning.

Additional aspects of the disclosure will be set forth in part in the description which follows and, in part, will be apparent from the description, or may be learned by practice of the disclosure.

In accordance with one aspect of the present disclosure, a refrigerator includes a body, a storage compartment, an ice making compartment, a cool air supplying apparatus, an ice making tray, an ejector, an ice bucket, and a driving apparatus.

The storage compartment may be formed at an inside the body. The ice making compartment may be provided at an inside the body while being divided from the storage compartment. The cool air supplying apparatus may have a compressor, a condenser, an expansion apparatus, an evaporator, and a refrigerant pipe, at least a portion of which is disposed at an inside the ice making compartment so that a cooling energy is supplied to the ice making compartment. The ice making tray may be configured to be contacted with the refrigerant pipe in the ice making compartment so that the ice making tray directly receives cooling energy from the refrigerant pipe in the ice making compartment. The ejector may be rotatively disposed at an upper side of the ice making tray to separate ice from the ice making tray. The ice bucket may be provided at a lower side of the ice maker to store the ice separated from the ice making tray. The driving apparatus may be disposed at one longitudinal side of the ice making tray to drive the ejector and control an ice making process. The driving apparatus may include a driving apparatus case, a cover, and a driving module. The driving apparatus case may be provided with an open front surface and having an inside space thereof. The cover may be configured to be attached/detached on the open front surface of the driving apparatus case to open/close the open front surface of the case. The driving module may have an ice separating motor configured to generate a rotational force to rotate the ejector, a circuit board configured to control the ice making process, and a module case configured to accommodate the ice separating motor and the circuit board. The driving module may be configured to be inserted in a sliding manner to be mounted at the inside space of the driving apparatus case through the open front surface of the driving apparatus case, or may be configured to be withdrawn in a sliding manner through the open front surface of the driving apparatus case to be separated from the inside space of the driving apparatus case.

Each of the module case and the driving apparatus case may be provided with at least one coupling hole, to which a coupling member is coupled, formed thereto in order to fix the driving module at the inside space of the driving apparatus case.

The coupling member may be coupled to the coupling hole through the open front surface of the driving apparatus case.

The driving module may include a driving gear coupled to a rotational shaft of the ice separating motor, a driven gear coupled to a rotational shaft of the ejector, and at least one electro-motion gear coupled in between the driving gear and the driven gear in an interlocking manner.

The electro-motion gear may include a large-size gear configured to receive a rotational force and a small-size gear having a smaller radius compared to a radius of the large-size gear to deliver the received rotational force at a reduced speed.

The driven gear may be disposed at an outside the module case.

The driven gear may include a connecting bar having an insertion groove into which the rotational shaft of the ejector is inserted, and protruded toward a direction of a shaft of the driven gear in order to rotate along with the driven gear, and the ejector may be rotated along with the driven gear as the rotational shaft of the ejector is insertedly coupled to the insertion groove.

The module case may be formed with a heat insulation material.

In accordance with another aspect of the present disclosure, a refrigerator includes a body, a storage compartment, an ice making compartment, a cool air supplying apparatus, an ice making tray, an ejector, an ice bucket, and a driving apparatus. The storage compartment may be formed at an inside the body. The ice making compartment may be provided at an inside the body while being divided from the storage compartment. The cool air supplying apparatus may have a compressor, a condenser, an expansion apparatus, an evaporator, and a refrigerant pipe, at least a portion of the refrigerant pipe is disposed at an inside the ice making compartment so that a cooling energy is supplied to the ice making compartment. The ice making tray may be configured to be contacted with the refrigerant pipe in the ice making compartment so that the ice making tray directly receives cooling energy from the refrigerant pipe in the ice making compartment. The ejector may be rotatively disposed at an upper side of the ice making tray to separate ice from the ice making tray. The ice bucket may be provided at a lower side of the ice maker to store the ice separated from the ice making tray. The driving apparatus may be disposed at one longitudinal side of the ice making tray to drive the ejector and control an ice making process. The driving apparatus may include a driving apparatus case and a driving module configured to be attached/detached at an inside the driving apparatus case. The driving module may include a module case, an ice separating motor accommodated at an inside the module case and configured to generate a rotational force, and a plurality of gears configured to rotate while being interlocked to each other so that the rotational force of the ice separating motor is delivered to the ejector, and at least one of the plurality of gears may be disposed at an outside the module case so that the at least one gear is coupled to a rotational shaft of the ejector.

A rotational shaft of the at least one gear disposed at the outside the module case is formed in a same line with the rotational shaft of the ejector.

The at least one gear disposed at the outside the module case may be provided with an insertion groove formed thereto so that the rotational shaft of the ejector is insertedly coupled to the insertion groove.

As described above, a driving module may be mounted at an inside the driving apparatus case, thereby completing an assembly of a driving apparatus, and thus the assembly quality of the driving apparatus is improved.

In addition, the components of a driving module such as an ice separating motor configured to drive an ejector and an electro-motion member configured to control an ice making process are accommodated at an inside a module case, thereby preventing frost from forming as a result of a contact with cool air, and thus a malfunction may be avoided.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
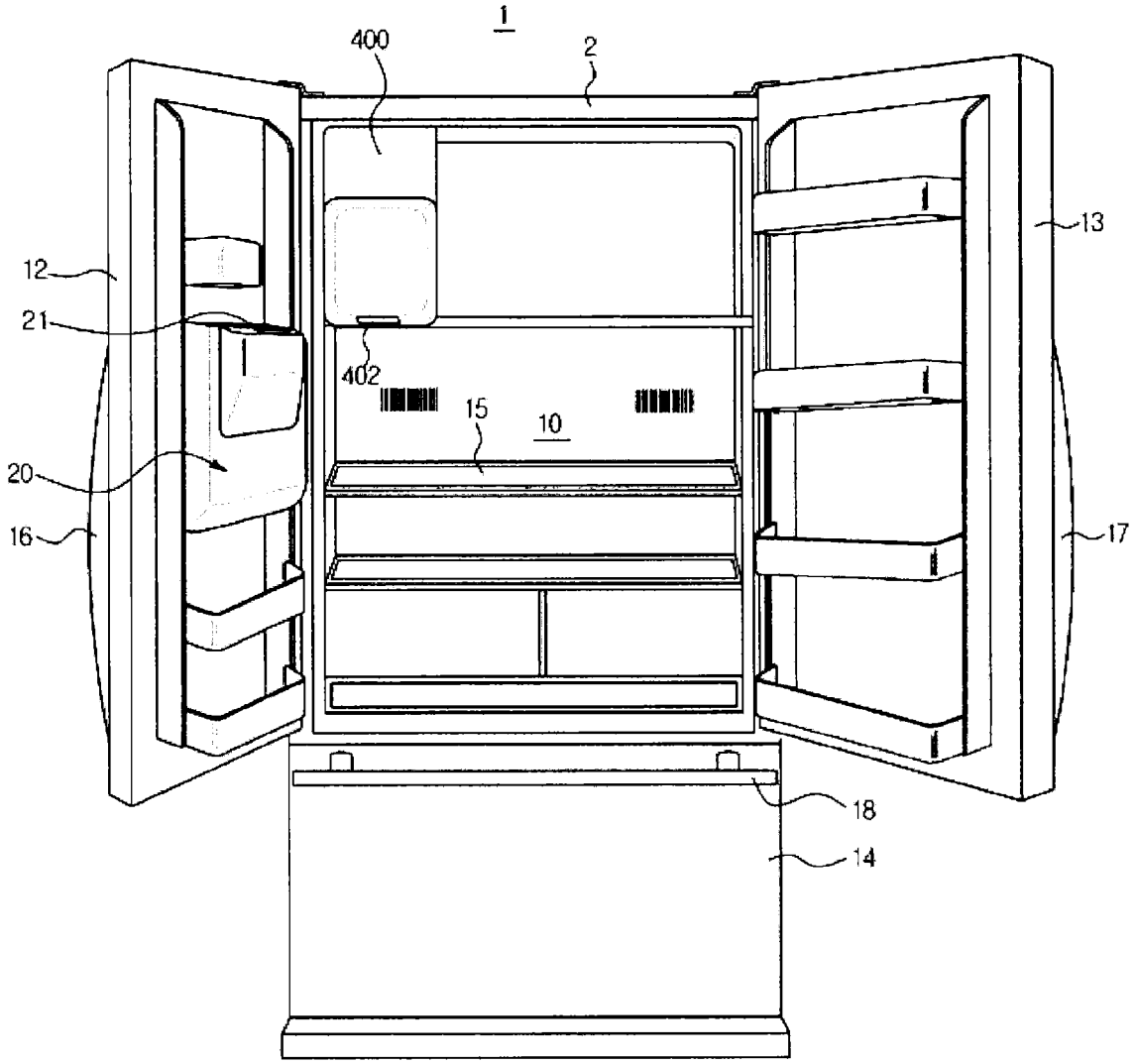
FIG. 1 is a front view of a refrigerator according to an embodiment of the present disclosure.

Reference will now be made in detail to the embodiments of the present disclosure, examples of which are illustrated in the accompanying drawings, wherein like reference numerals refer to like elements throughout.

Figure 2:
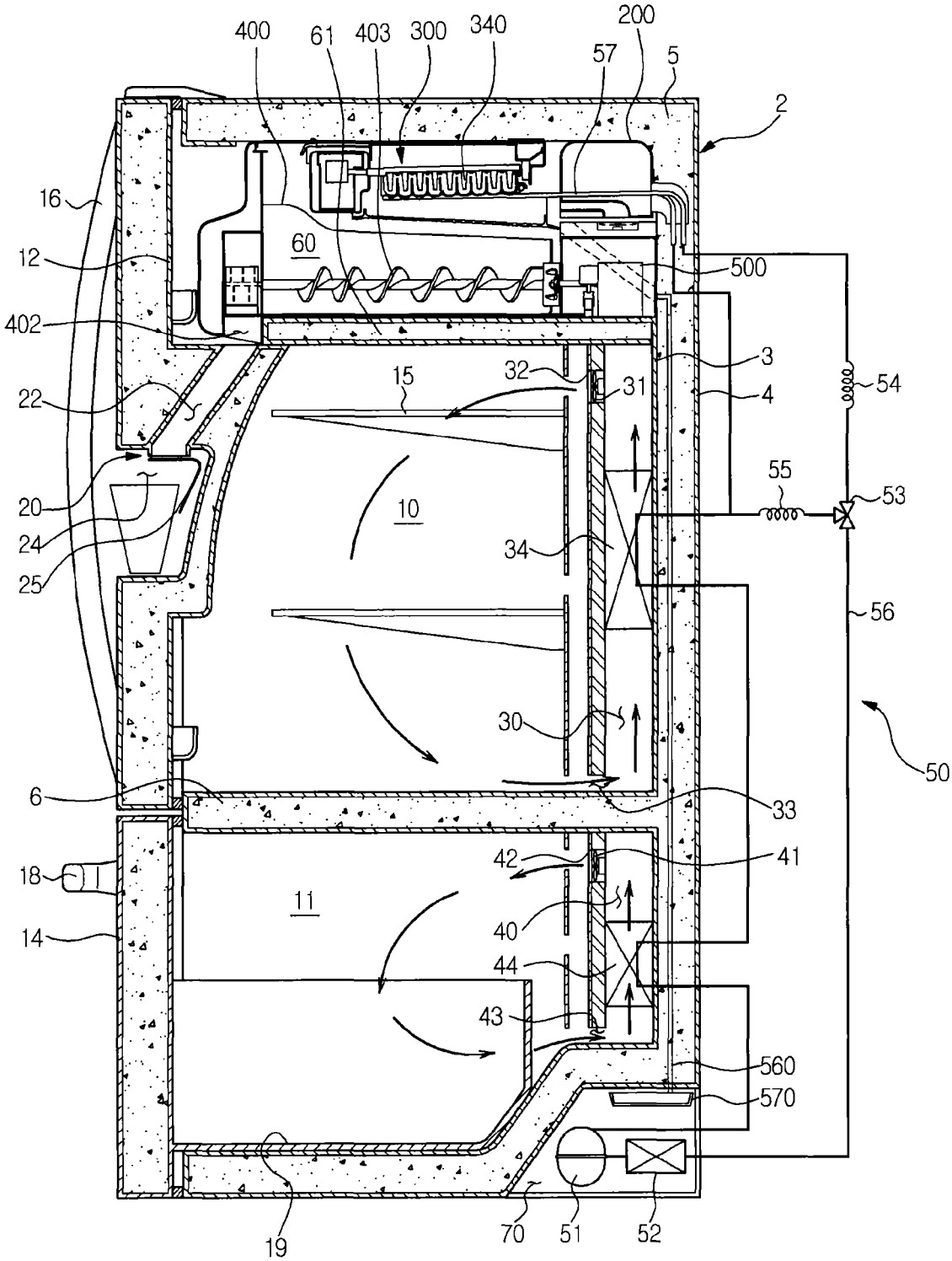
FIG. 2 is a side cross-sectional view of the refrigerator of FIG. 1.
Figure 3:
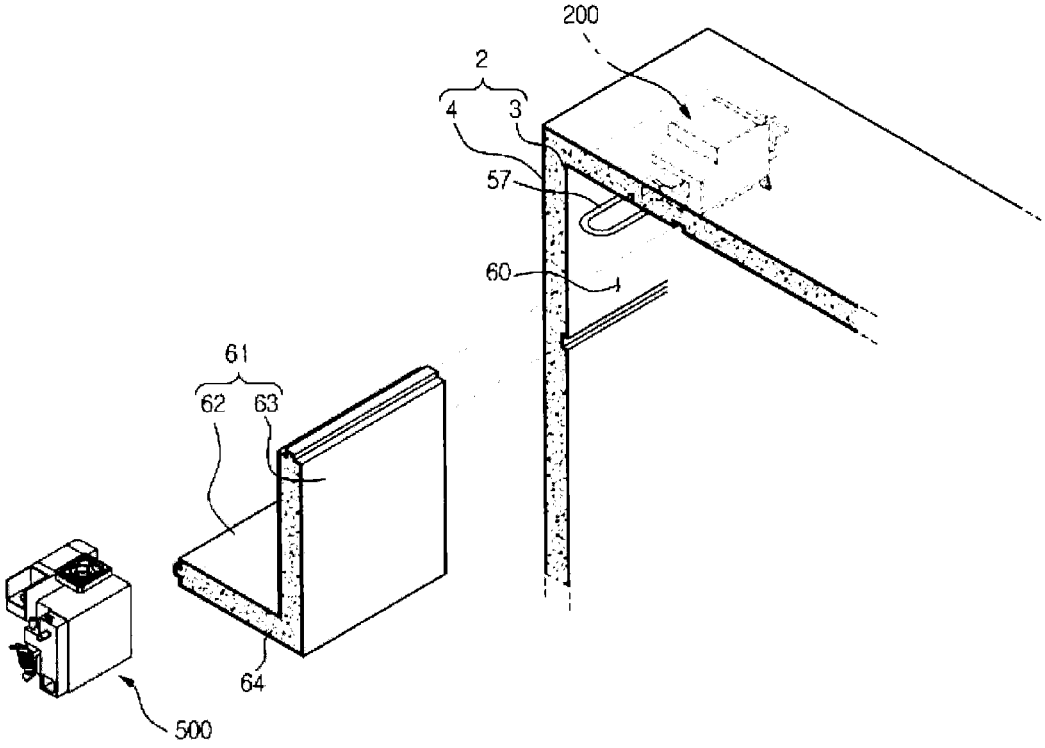
FIG. 3 is a drawing explaining a process of installing an auger motor assembly at an ice making compartment of the refrigerator of FIG. 1.

FIG. 1 is a front view of a refrigerator according to an embodiment of the present disclosure, FIG. 2 is a side cross-sectional view of a refrigerator of FIG. 1, and FIG. 3 is a drawing explaining a process of installing an auger motor assembly at an ice making compartment of the refrigerator of FIG. 1.

As illustrated in FIGS. 1 to 3, a refrigerator 1 according to the embodiment of the present disclosure is composed of by including a body 2, storage compartments 10 and 11 to store foods refrigerated or frozen, an ice making compartment 60 to generate ice, and a cooling air supplying apparatus 50 to supply cool air to the storage compartments 10 and 11, and to the ice making compartment 60.

The body 2 is composed of by including an outer case 4 forming an exterior, an inner case 3 forming the storage compartments 10 and 11 and the ice making compartment 60, and an insulation material 5 foamed in between the outer case 4 and the inner case 3.

The storage compartments 10 and 11 are provided with an open front surface thereof, and may be divided into an upper side refrigerating compartment 10 and a lower side freezing compartment 11 by a horizontal partition 6. The horizontal partition 6 may include an insulation material to block the heat exchange of the refrigerating compartment 10 and the freezing compartment 11.

The refrigerating compartment 10 may be provided therein with a shelf 15 to place food thereon and to divide the storage compartment into an upper space and a lower space. The open front surface of the refrigerating compartment 10 may be open/closed by a pair of doors 12 and 13 rotatively hinge-coupled to the body 2. The doors 12 and 13 may be provided thereto with handles 16 and 17 to open each of the doors 12 and 13.

The doors 12 and 13 as such may be provided thereto with a dispenser 20 through which the ice generated may be withdrawn out from an outside without having to open the doors 12 and 13. The dispenser 20 may be composed by including a withdrawal space 24 from which ice may be withdrawn, a lever 25 configured to choose whether the ice is to be withdrawn, and a chute 22 configured to guide the ice withdrawn through an ice withdrawal hole 21 which is adjacent to an ice discharging hole 402 of an ice bucket 400, which are to be described later.

The open front surface of the refrigerating compartment 11 may be open/closed by a sliding door 14 configured to be inserted into the refrigerating compartment 11 in a sliding manner. The rear surface of the sliding door 14 may be provided with a storage box 19 integrally formed thereto to store foods. The sliding door 14 may be provided thereto with a handle 18 to open/close the sliding door 14.

Meanwhile, as illustrated on FIG. 2, the refrigerator 1 includes a cool air supplying apparatus 50 capable of supplying cool air to the storage compartments 10 and 11, and to the ice making compartment 60. The cool air supplying apparatus 50 may be composed of a compressor 51 to compress a refrigerant using a high pressure, a condenser 52 to condense the compressed refrigerant, expansion apparatuses 54 and 55 to expand the refrigerant using a low pressure so that the refrigerant may be easily evaporated, evaporators 34 and 44 to generate cool air by evaporating the refrigerant, and a refrigerant pipe 56 to guide the refrigerant.

The compressor 51 and the condenser 52 may be disposed at a machinery room 70 provided at a lower portion of a rear of the body 2. In addition, each of the evaporators 34 and 44 may be disposed at a refrigerating compartment cool air supplying duct 30 provided at the refrigerating compartment 10 and at a freezing compartment cool air supplying duct 40 provided at the freezing compartment 11. Thus, the refrigerating compartment 10 and the freezing compartment 11 may be independently cooled.

The refrigerating compartment cool air supplying duct 30 includes an intake hole 33, a cool air discharging hole 32, and a draft fan 31, and may circulate a cool air at an inside the refrigerating compartment 10. In addition, the freezing compartment cool air supplying duct 40 includes an intake hole 43, a cool air discharging hole 42, and a draft fan 41, and may circulate a cool air at an inside the freezing compartment 11.

Meanwhile, a portion 57 of the refrigerant pipe 56 is extendedly disposed at an inside the ice making compartment 60 to cool the ice making compartment 60. As such, a refrigerant pipe 57 extendedly disposed at an inside the ice making compartment 60 will be hereafter called the ice making compartment refrigerant pipe 57.

The refrigerant pipe 56 may be configured in a way that the refrigerant flows through the ice making compartment 60, then the refrigerating compartment 10, and through the freezing compartment 11, or may be diverged at one point for the refrigerant to flow through the refrigerating compartment 10 and the freezing compartment 11 excluding the ice making compartment 60, and the divergent point may be provided with a changing valve 53 installed thereto to change the flow of the refrigerant.

Although to be described later, the refrigerator 1 according to the present disclosure may directly supply cooling energy as the refrigerant pipe 57 disposed at an inside the ice making compartment 60 is being contacted at an ice making tray 340 of an ice maker 300.

Meanwhile, the ice making compartment 60 may be provided at an inside the body 2 in a way to be divided from the storage compartments 10 and 11. The open front surface of the ice making compartment 60 may be closed by an ice making compartment cover 404 of the ice bucket 400, which will be described later.

The ice making compartment 60 may be provided at an upper portion of a one side of the refrigerating compartment 10, and may be formed in a way to be divided from the refrigerating compartment 10 by an ice making compartment wall 61. As illustrated on FIG. 3, the ice making compartment wall 61 includes a horizontal wall 62 and a vertical wall 63, and may include an insulation material 64 to block the heat exchange of the ice making compartment 60 and the refrigerating compartment 10.

The ice making compartment wall 61 may be installed to the inner case 3 of the body 2 through an insertion-coupling structure or through a screw-coupling structure. In addition, an ice making compartment wall 31 may be assembled to the inner case 3 of the body 2 before the insulation material 5 is foamed in between the inner case 3 of the body 2 and the outer case 4.

As illustrated on FIG. 2, the ice making compartment 60 as such is provided therein with an automatic ice making assembly 100 to generate ice. The automatic ice making assembly 100 may be composed by including an air duct 200 configured to insulate the ice making compartment refrigerant pipe 57 and to form a portion of the flow path of the cool air at an inside the ice making compartment 60, the ice maker 300 to store the ice generated at the ice maker 300, and an auger motor assembly 500 to operate an auger 403 that moves ice. Hereinafter, the structure of the automatic ice making assembly as such will be described in detail.

Figure 4:
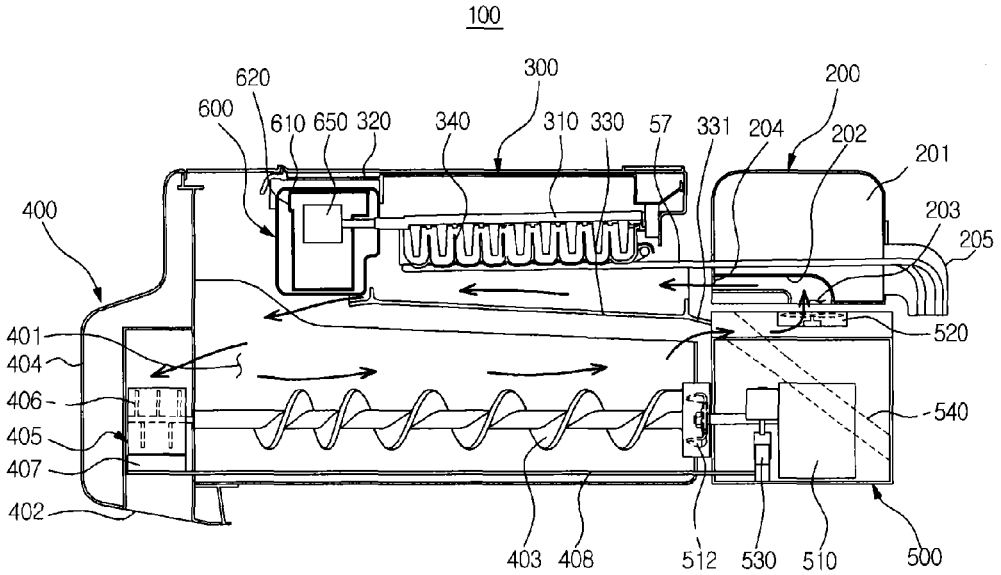
FIG. 4 is a side cross-sectional view illustrating the components of the ice making compartment of the refrigerator of FIG. 1.
Figure 5:
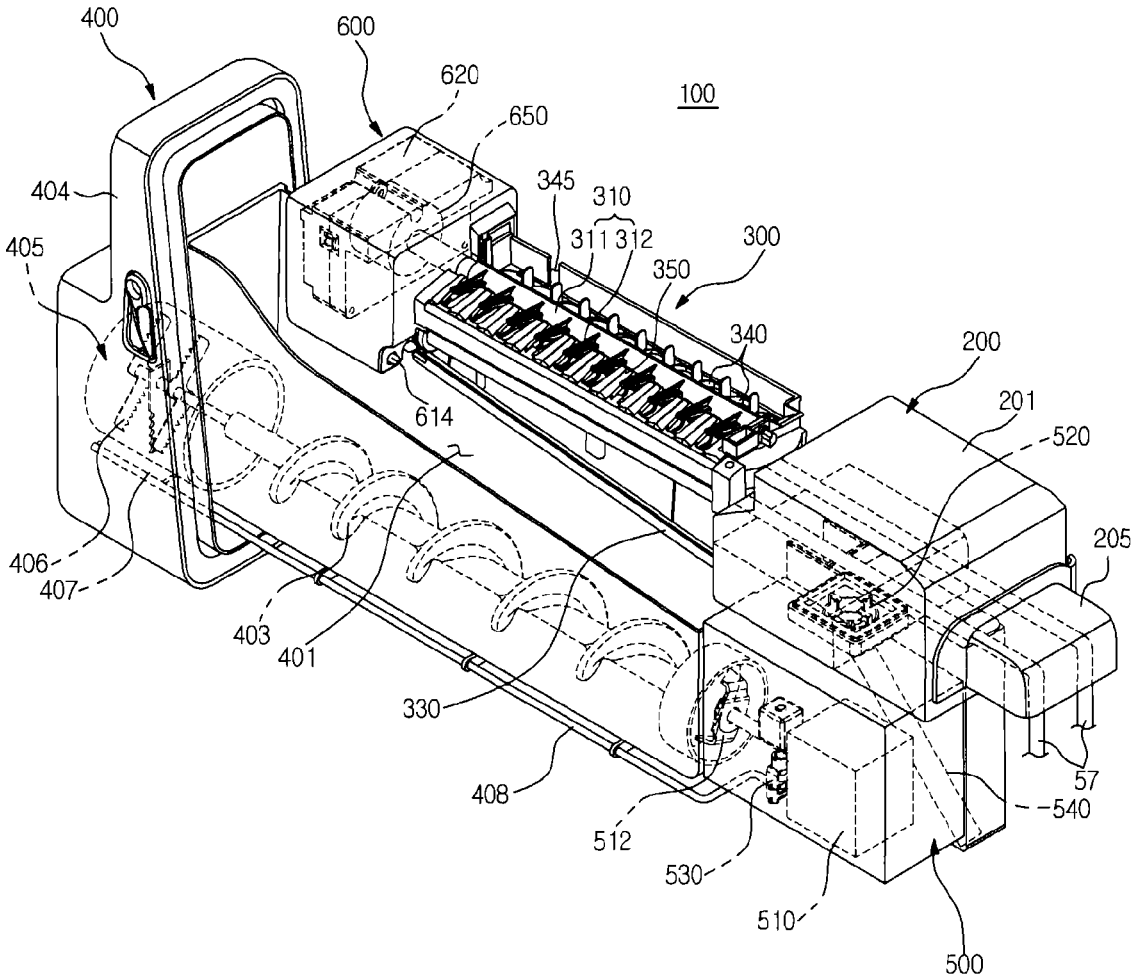
FIG. 5 is a perspective view illustrating the components of the ice making compartment of the refrigerator of FIG. 1.
Figure 6:
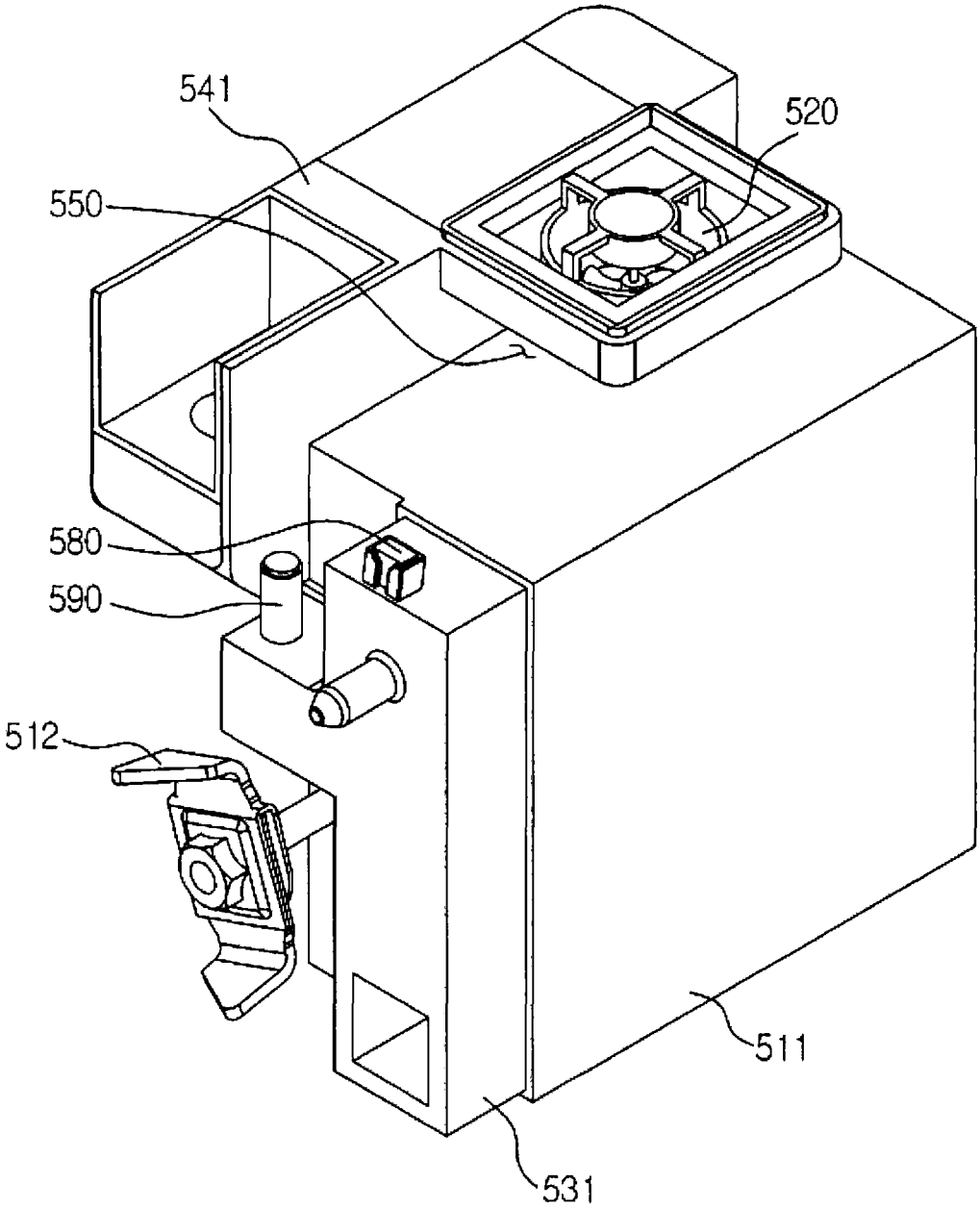
FIG. 6 is a perspective view illustrating an assembly of an auger motor and a fan of the refrigerator of FIG. 1.
Figure 7:
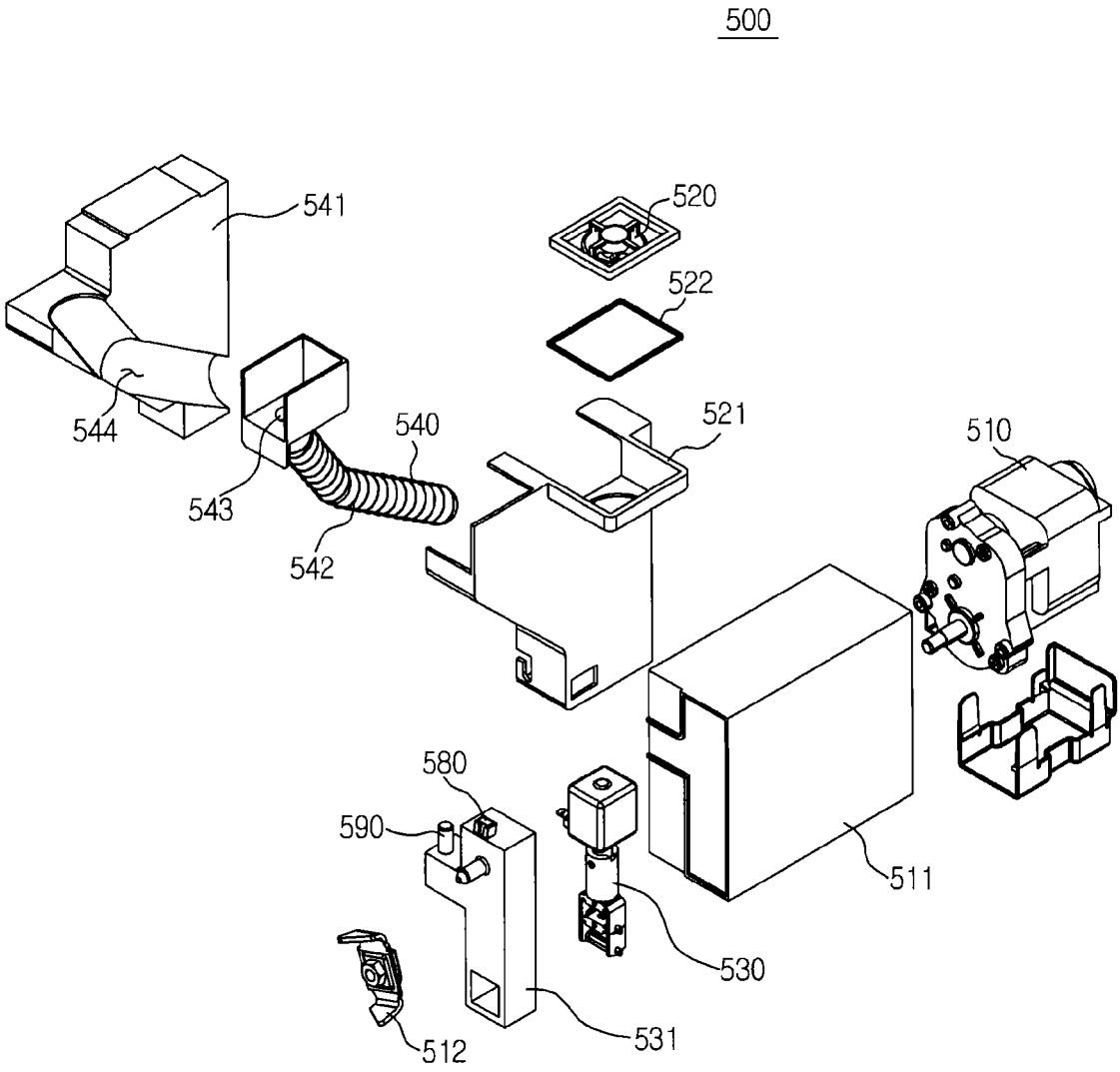
FIG. 7 is an exploded perspective view illustrating an assembly of an auger motor and a fan of the refrigerator of FIG. 1.
Figure 8:
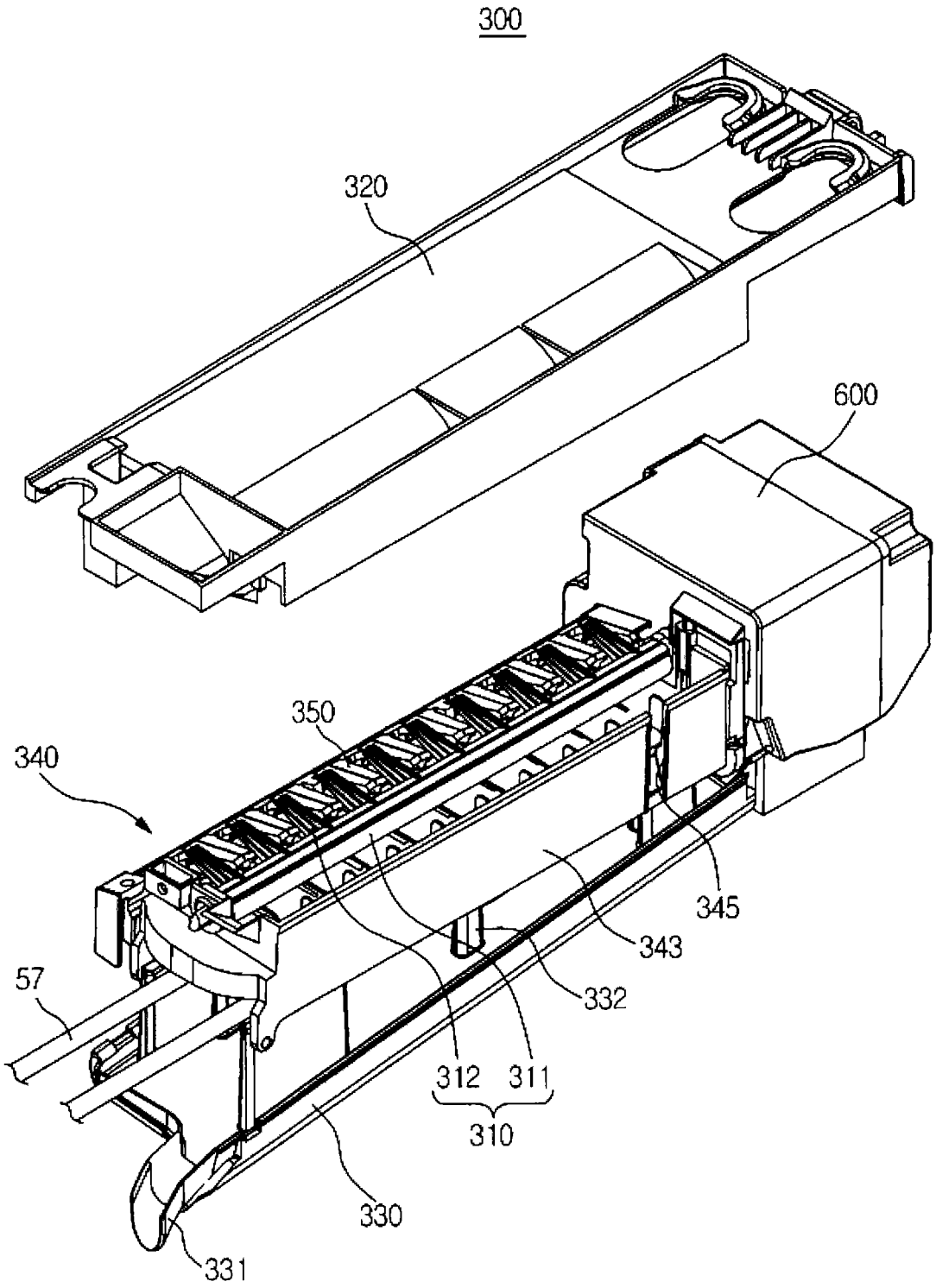
FIG. 8 is a perspective view illustrating an ice maker of the refrigerator of FIG. 1.
Figure 9:
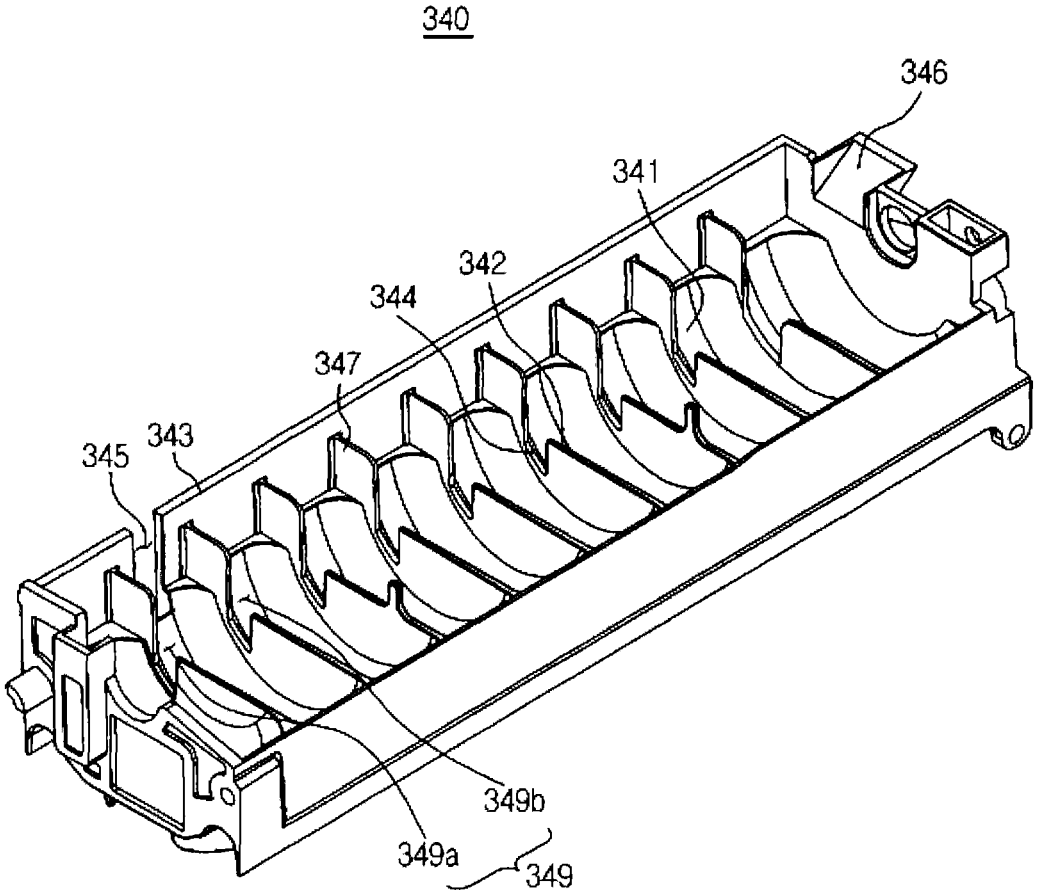
FIG. 9 is a perspective view illustrating an ice making tray of the refrigerator of FIG. 1.
Figure 10:
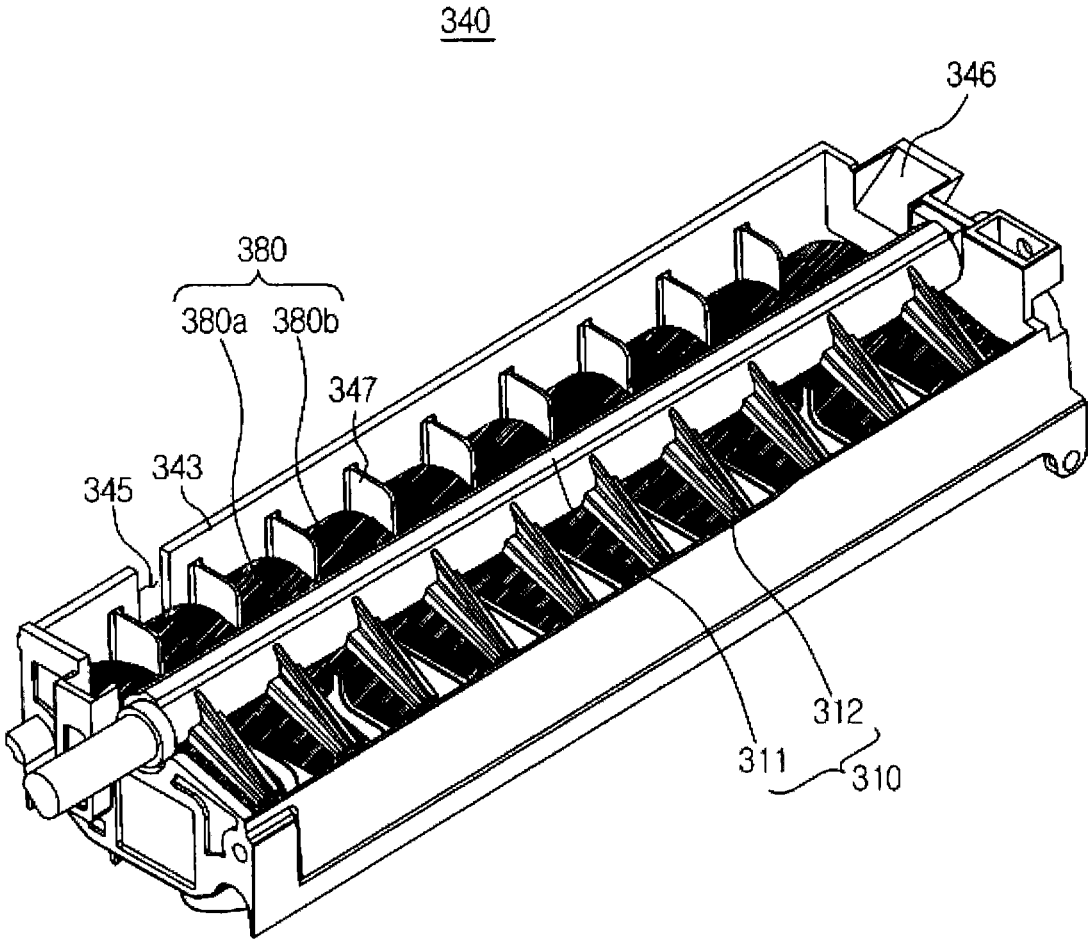
FIG. 10 is a cross-sectional view illustrating a state of ice formed at the ice making tray of the refrigerator of FIG. 1.
Figure 11:
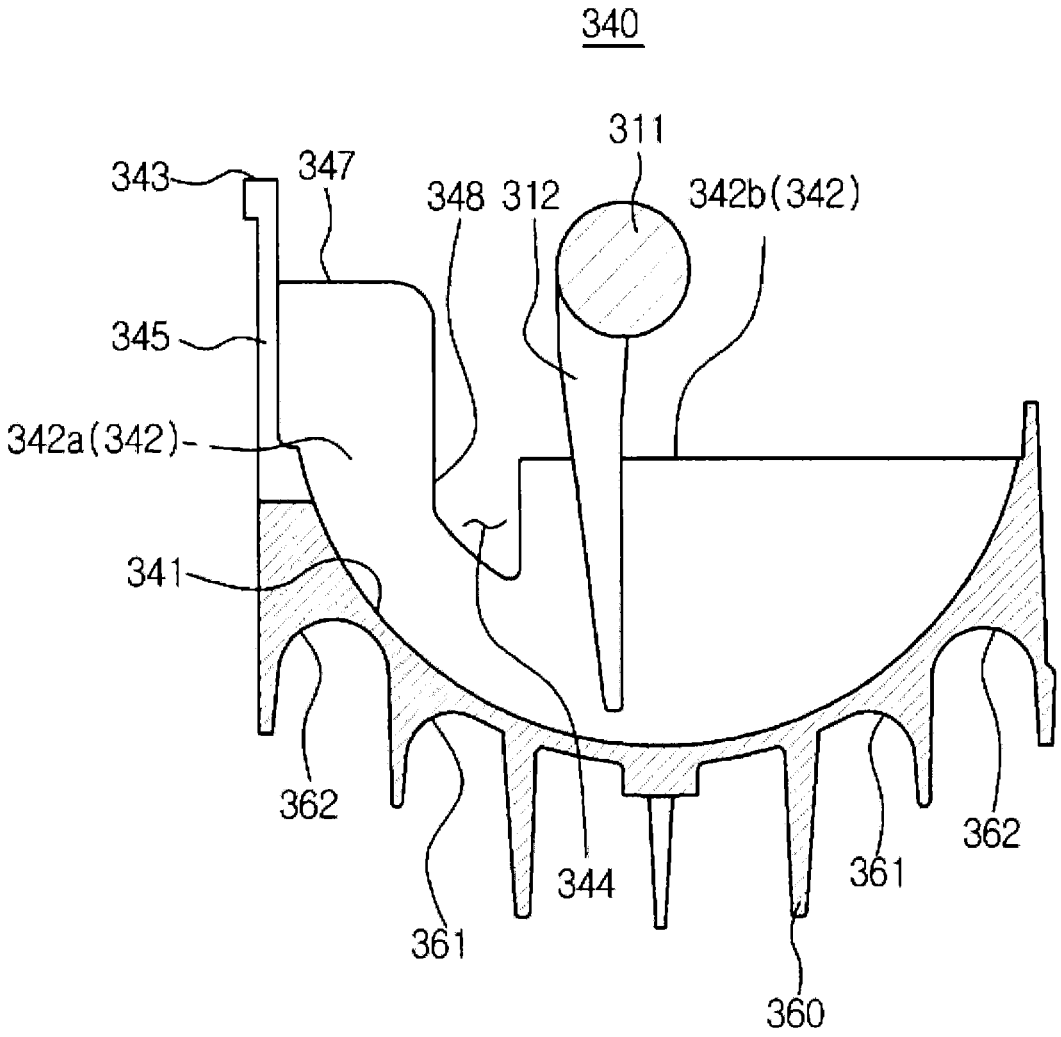
FIG. 11 is a cross-sectional view illustrating the ice making tray of the refrigerator of FIG. 1.
Figure 12:
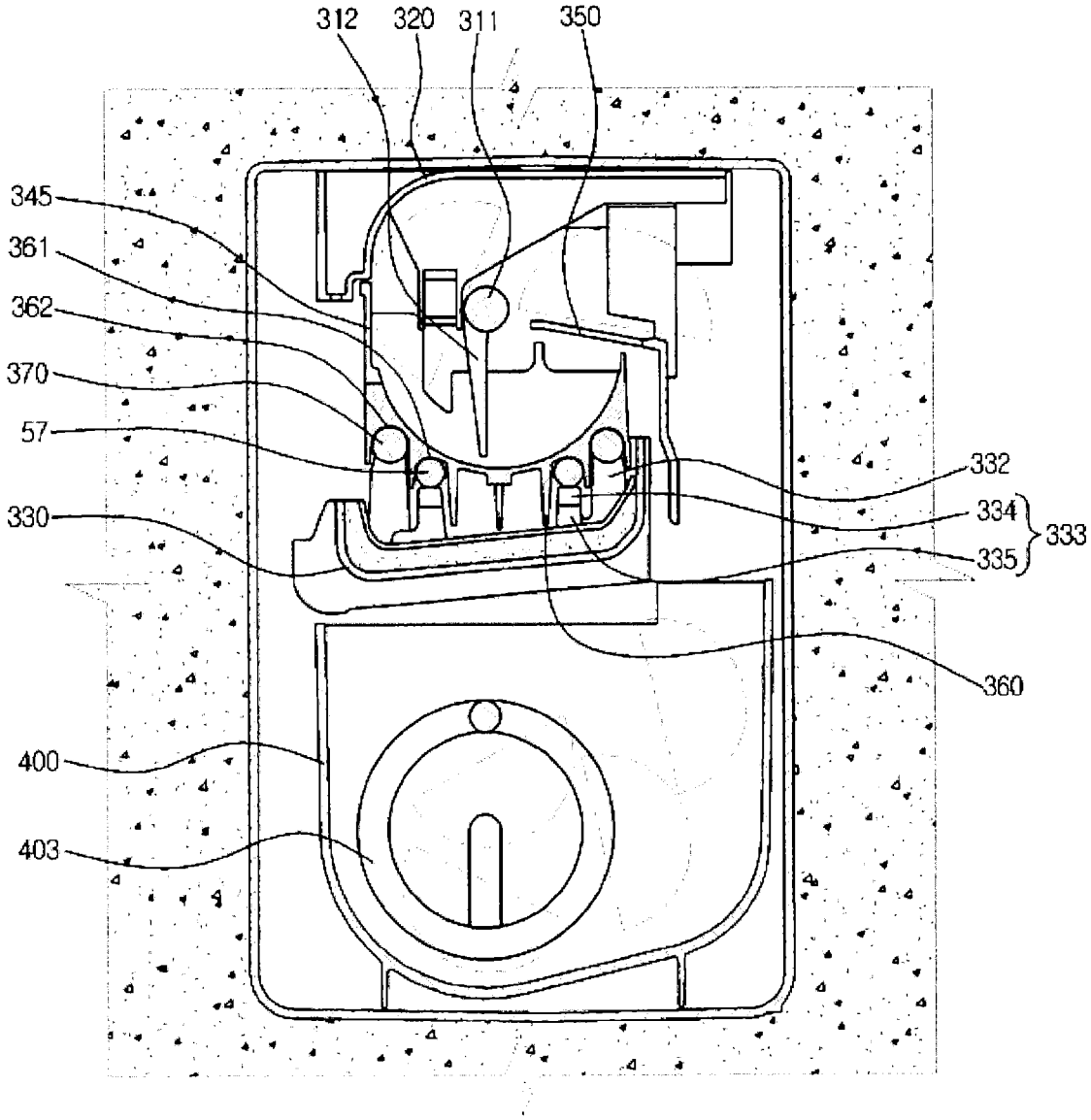
FIG. 12 is a cross-sectional view illustrating a structure of the ice making compartment of the refrigerator of FIG. 1.
Figure 13:
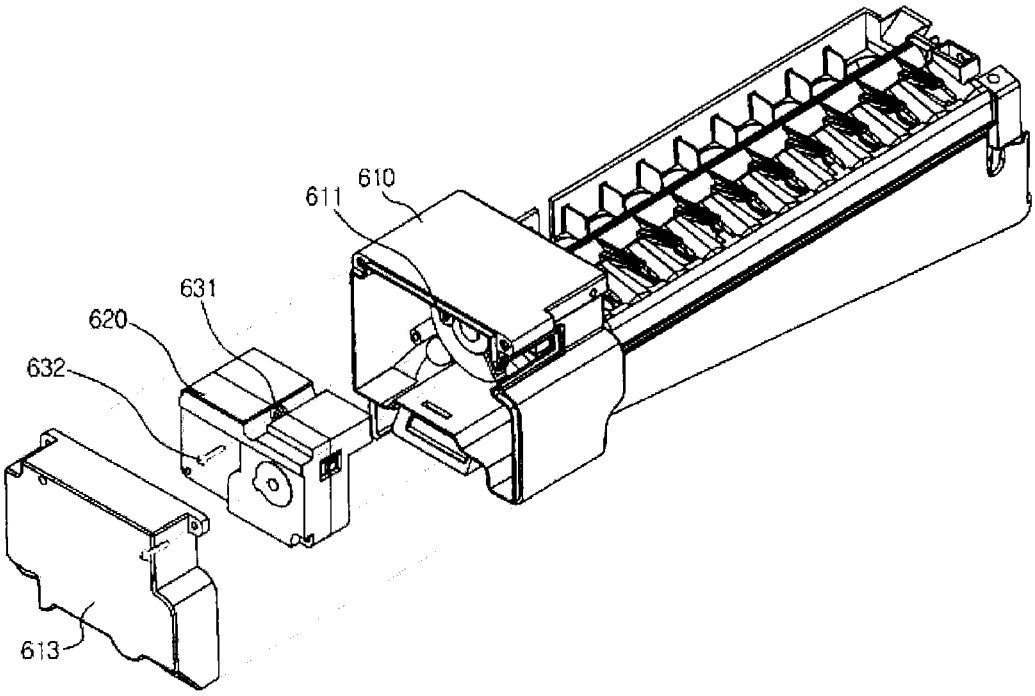
FIG. 13 is a perspective view illustrating a driving apparatus of the ice maker of the refrigerator of FIG. 1.
Figure 14:
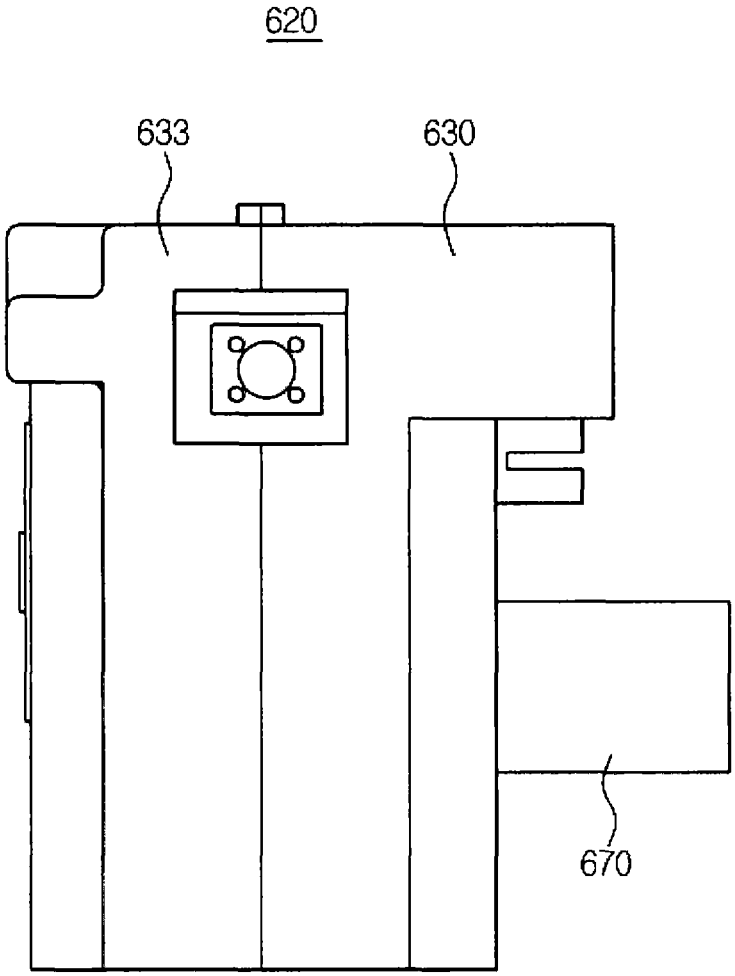
FIG. 14 is a side view illustrating a driving module of the ice maker of the refrigerator of FIG. 1.
Figure 15:
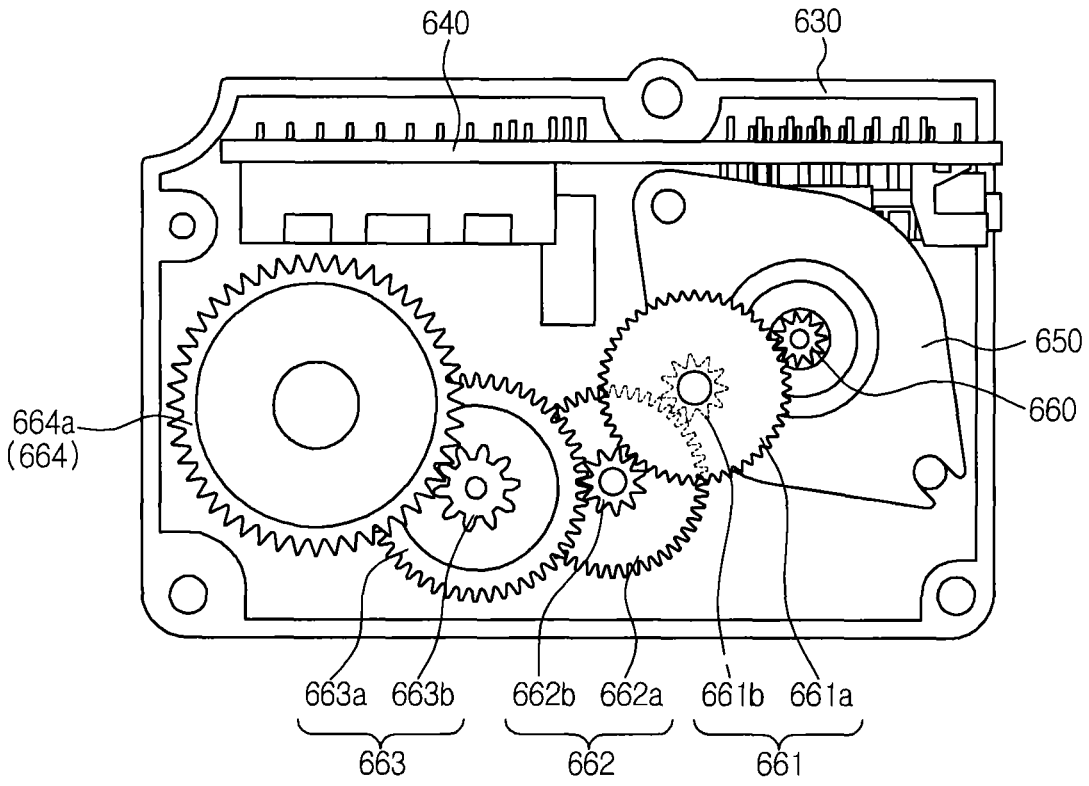
FIG. 15 is a drawing illustrating an inside the driving module of the ice maker of the refrigerator of FIG. 1.
Figure 16:
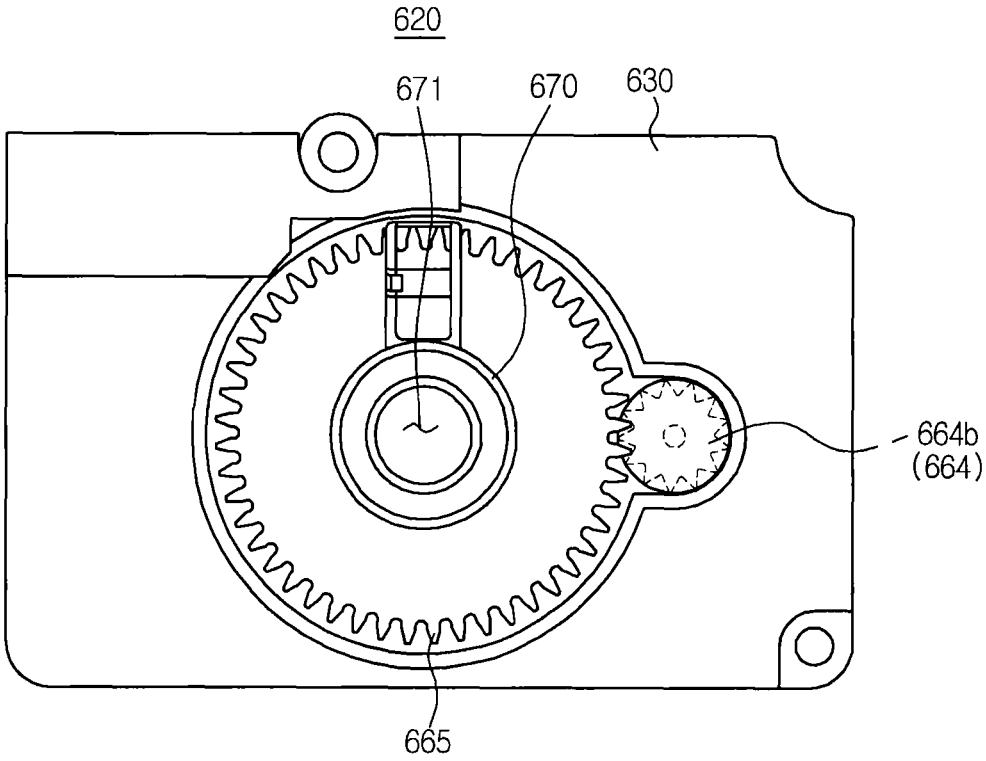
FIG. 16 is a rear view illustrating the driving module of the ice maker of the refrigerator of FIG. 1.

FIG. 4 is a side cross-sectional view illustrating the components of the ice making compartment of the refrigerator of FIG. 1, FIG. 5 is a perspective view illustrating the components of the ice making compartment of the refrigerator of FIG. 1, FIG. 6 is a perspective view illustrating an assembly of an auger motor and a fan of the refrigerator of FIG. 1, FIG. 7 is an exploded perspective view illustrating an assembly of an auger motor and a fan of the refrigerator of FIG. 1, FIG. 8 is a perspective view illustrating an ice maker of the refrigerator of FIG. 1, FIG. 9 is a perspective view illustrating an ice making tray of the refrigerator of FIG. 1, FIG. 10 is a cross-sectional view illustrating a state of ice formed at the ice making tray of the refrigerator of FIG. 1, FIG. 11 is a cross-sectional view illustrating the ice making tray of the refrigerator of FIG. 1, FIG. 12 is a cross-sectional view illustrating a structure of the ice making compartment of the refrigerator of FIG. 1, FIG. 13 is a perspective view illustrating a driving apparatus of the ice maker of the refrigerator of FIG. 1, FIG. 14 is a side view illustrating a driving module of the ice maker of the refrigerator of FIG. 1, FIG. 15 is a drawing illustrating an inside the driving module of the ice maker of the refrigerator of FIG. 1, and FIG. 16 is a rear view illustrating the driving module of the ice maker of the refrigerator of FIG. 1.

First, by referring to FIGS. 4 to 5, the air duct 200 of the automatic ice making assembly 100 may be composed of an insulation material 201 provided to insulate the ice making compartment refrigerant pipe 57 from an outside by surround the ice making compartment refrigerant pipe 57, a fixing member 205 configured to fix the ice making compartment refrigerant pipe 57 to the ice making compartment 60, and an inner flow path 202 configured to form a portion of the flow path of the cool air at an inside the ice making compartment 60.

The insulation material 201 is composed in a way to surround the ice making compartment refrigerant pipe 57, and may insulate the ice making compartment refrigerant pipe 57 and at the same time prevent the deformation such as bending of the ice making compartment refrigerant pipe 57. The fixing member 205 is coupled to the inner case 3 of the body 2 and may fix the ice making compartment refrigerant pipe 57. The air duct 200 as such may be installed at the inner case 3 of the body 2 before the ice making compartment wall 61 is assembled to the inner case 3 of the body 2.

Meanwhile, an entry 203 of an inside flow path 202 is formed at a lower surface of the air duct 200, and an exit 204 of the inside flow path 202 is formed at a front surface of the air duct 200, so that the air duct 200 may discharge cool air to a front by intaking the air from a lower side. The flow of the cool air at an inside the ice making compartment 60 will be described later.

The ice maker 300 of the automatic ice making assembly 100 may be composed of an ice making tray 340 at which water is actually supplied and ice is generated, an ejector 310 separating the ice from the ice making tray 340, a drain duct 330 to guide the excess water flowing over from the ice making tray 340 or the defrost water of the ice making tray 340, and a driving apparatus 600 to drive the ejector 310.

The lower portion of the ice making tray 340 may be provided with a refrigerant pipe contacting unit 361 (FIG. 12) formed along a longitudinal direction thereto, and the refrigerant pipe contacting unit 361 is provided with a shape of a groove at which the ice making compartment refrigerant pipe 57 may be installed thereto, so that the ice making compartment refrigerant pipe 57 may be directly contacted with the ice making compartment refrigerant pipe 57.

In addition, the ice making tray 340 may be formed with the material having high thermal conductivity such as aluminum, and a lower portion of the ice making tray 340 may be provided with a plurality of heat exchanging ribs 360 (FIG. 12) formed thereto so that the heat-exchanging performance may be enhanced by increasing the contact area with air.

Thus, the ice making tray 340 may perform a function as a heat exchanger, and may cool the water accommodated at an ice making space 349 (FIG. 9).

Meanwhile, as illustrated on FIGS. 9 to 12, the ice making tray 340 includes the ice making space 349 at which water may be supplied and ice may be generated. The ice making space 349 may be formed by a bottom unit 341 having a shape of a circular arc with a predetermined radius. In addition, the ice making space 349 may be divided into a plurality of unit ice making spaces 349*a* and 349*b* by a plurality of partition wall units 342 that are protruded from the bottom unit 341 toward an upper side thereof. However, for the sake of convenience, marks are assigned only to the two units of the plurality of unit ice making spaces 349*a* and 349*b*.

The partition wall unit 342 may be provided with a communicating unit 344 formed thereto, and the communicating unit 344 is configured to communicate adjacent unit ice making spaces 349*a* and 349*b* to each other among the plurality of unit ice making spaces so that the water introduced through a water supply hole 346, which is formed at a one longitudinal side of the ice making tray 340, may be supplied to all of the plurality of unit ice making spaces.

In addition, a derailment prevention wall 343 extended toward an upper side thereof may be formed at one width side of the ice making tray 340, so that the ice formed at the ice making space 349 from freefalling and at the same time the ice may be guided to a slider 350 (FIG. 12).

Meanwhile, the ice making tray 340, in a case when the water exceeding the predetermined amount is supplied to the ice making space 349, may further include an opening hole unit 345 to discharge the excess water. The opening hole unit 345 may be consecutively formed at the bottom unit 341 and the derailment prevention wall 343, and may be formed at an upper portion of a certain one 349*a* of the plurality of unit ice making spaces 349*a* and 349*b* in a communicating manner.

Under the structure as such, the water exceeding the predetermined amount may be discharged to an outside the ice making tray 340 through the opening hole unit 345, and the ice generated through the ice making tray 340 may not exceed a certain size. Thus, in a case when the ice is separated at the ice making tray 340, the phenomenon of the ice separating interfered by having the ice stuck at an ice making tray fixing apparatus 320 or at the ice making compartment wall 61 may be prevented.

As the ice making tray 340 is disposed in an inclined manner so that one end portion in a longitudinal direction thereof, that is, the one end portion to which the water supply hole 346 is formed, may be positioned at a relatively higher position than the other end portion in a longitudinal direction thereof, the opening hole unit 345 is desired to be formed closer to the other end portion of the ice making tray 340 than the one end portion of the ice making tray 340 to which the water supply hole 346 is formed. In addition, the opening hole unit 345 is desired to be formed at a higher position than the communicating unit 344 so that water may be supplied to all of the unit ice making spaces 349*a*.

The water discharged through the opening hole unit 345 as such freefalls to the drain duct 330 that is disposed at a lower side of the ice making tray 340. The drain duct 330 is disposed in a modestly inclined manner so that the water falling through the opening hole unit 345 may flow to a guide unit 331 that is formed at one longitudinal end portion of the drain duct 330. In addition, the guide unit 331 may guide the water that is discharged through the opening hole unit 345 to a drain hose (540 in FIG. 4) of the auger motor assembly 500, which will be described later.

Meanwhile, as unit ices 380*a* and 380*b* (FIG. 10) generated at the unit ice making spaces 349*a* and 349*b* are generated while linked to each other by the communicating unit 344, the ice making tray 340 of the refrigerator 1 according to the embodiment of the present disclosure may further include a plurality of cutting ribs 347 configured to crush the link. For the sake of convenience, the unit ices 380*a* and 380*b* are only provided with marks on the drawing among a plurality of unit ices.

The cutting rib (347 in FIG. 11) is protruded from the partition wall unit 342 toward an upper side thereof, and may be formed in a way to be contacted at the derailment prevention wall 343. That is, with respect to the communicating unit 344, a portion of the partition wall unit 342 adjacent to the derailment prevention wall 343 is referred to as a first partition wall unit (342*a* in FIG. 11), and a portion of the partition wall unit 342 positioned opposite of the derailment prevention wall 343 is referred to as a second partition wall unit (342*b* in FIG. 11), and the cutting rib 347 may be formed in a way to be extended from the first partition wall unit 342*a* toward an upper side thereof.

The cutting rib 347 may crush the link among the unit ices 380*a* and 380*b* as the ejector 310 lifts the ice 380 at the ice making space 349 as the ejector 310 rotates. Thus, the phenomenon, that is, the ice being stuck, that may develop by the link among the unit ices 380*a* and 380*b* during an ice separating process may be prevented, and the unit ices 380*a* and 380*b* may be separated at a designated position without being interfered by each other.

As for the cutting rib 347 as such, the height to the upper edge of the cutting rib 347 is desired to be larger than the half the height to the upper edge of the partition wall unit 342. Meanwhile, the ice making tray 340 including the bottom 341, the derailment prevention wall 343, the plurality of partition wall units 342, and the plurality of cutting ribs 347 may be integrally molded as a single mold.

In addition, the ice making tray 340 may be provided with an ice separating heater 370, which is configured to heat the ice making tray 340 installed thereto, so that the ice 380 may be easily separated from the ice making tray 340 during the ice separating process. The ice separating heater 370 may be disposed in a way to be accommodated in an ice separating heater contacting unit 362 which is formed in a shape of a groove at a lower portion of the ice making tray 340.

Meanwhile, the ejector 310 configured to separate the ice 380 from the ice making tray 340 may include a rotating shaft 311 and a plurality of ejector pins 312 protruded from the rotating shaft 311. The ejector pin 312 may rotate while having the rotating shaft 311 as a center of rotation and separate the ice 380 from the ice making space 349.

Meanwhile, a front end portion in a longitudinal direction of the ice making tray 340 is provided with a driving apparatus 600 providing a rotational force to the ejector 310 and having electro-motion members configured to control a water supply process, an ice-making process, and an ice-transporting.

Referring to FIGS. 13 to 16, the driving apparatus 600 may be composed of a driving apparatus case 610 having an open front surface thereof and an inside space, a cover 613 to cover the open front surface of the driving apparatus case 610, and a driving module 620 which may be attached/detached at the inside space of the driving apparatus case 610.

The driving module 620 is a single entity module including an ice separating motor 650 configured to generate a rotational force to rotate the ejector 310, a circuit board 640 configured to control the ice-making process, and an electro-motion member to deliver the rotational force of the ice separating motor 650 to the ejector 310, and the components of the driving module 620 as such may be accommodated at a driving module case 630.

The driving module case 630 may be provided thereof with an open front surface, and the open front surface may be covered by the cover 633. The driving module 620 may be inserted in a sliding manner to an inside space of the driving apparatus case 610 through an open front surface of the driving apparatus case 610, and inversely, the driving module 620 may be withdrawn in a sliding manner through the open front surface of the driving apparatus case 610 to be separated from the inside space of the driving apparatus case 610.

Each of the driving module case 630 and the driving apparatus case 610 may be provided with coupling holes 631 and 611 into which a coupling member 632 each may be inserted, respectively, so that the driving module 620 may be fixedly coupled at an inside the driving apparatus case 610. At this time, the coupling member 632 may also be easily coupled to the coupling holes 631 and 611 through the open front surface of the driving apparatus case 610.

The electro-motion member of delivering the rotational force of the ice separating motor 650 to the ejector 310 may be a structure having a plurality of gears. That is, the electro-motion member may include a driving gear 660 coupled to the rotational shaft of the ice separating motor 650, a driven gear 664 coupled to the rotational shaft 311 of the ejector 310, and at least one electro-motion gear 661, 662, 663, and 664 coupled in an interlocked manner in between the driving gear 660 and the driven gear 665.

At this time, the electro-motion gears 661, 662, 663, and 664 may be composed of large-size gears 661*a*, 662*a* 663*a*, and 664*a* each configured to receive rotational force, and small-size gears 661*b*, 662*b*, 663*b*, and 664*b* each configured to deliver the rotational force, so that the rotational force may be delivered to the ejector 310 by reducing the rotational speed of the ice separating motor 650. Each of the small-size gears 661*b*, 662*b*, and 663*b* may be provided with a smaller radius and circumference compared to each of the large-size gears 661*a*, 662*a*, and 663*a*.

That is, the driving gear 660 is interlocked to the large-size gear 661*a* of the first electro-motion gear 661, the small-size gear 661*b* of the first electro-motion gear 661 is interlocked to the large-size gear 662*a* of the second electro-motion gear 662, the small-size gear 662*b* of the second electro-motion gear 662 is interlocked to the large-size gear 663*a* of the third electro-motion gear 663, the small-size gear 663*b* of the third electro-motion gear 663 is interlocked to the large-size gear 664*a* of the fourth electro-motion gear 664, and the small-size gear 664*b* of the fourth electro-motion gear 664 is interlocked to the driven gear 665.

Here, the driven gear 665 and the small-size gear 664*b* of the fourth electro-motion gear 664 that is interlocked to the driven gear 665 may be disposed at an outside the driving module case 630. Thus, a rotational shaft 313 of the ejector 310 may be coupled to the driven gear 665 at an outside the driving module case 630.

At this time, the rotational shaft of the driven gear 665 may be provided on a same line of the rotational shaft 313 of the ejector 310, and the driven gear 665 may be provided with a connecting bar 670 protruded therefrom along the axial direction and having an insertion groove 672 so that the rotational shaft 313 of the ejector 310 may be insertedly coupled to the insertion groove 671.

Thus, the rotational shaft 313 of the ejector 310 is insertedly coupled to the insertion groove 671 of the driven gear 665, and may rotate along with the driven gear 665.

Meanwhile, the driving module case 630 of the driving module 620 is formed using heat insulation material to prevent the components, such as the ice separating motor 650 and the printed circuit board 640 accommodated in the driving module case 630, from being defrosted due the cool air of outside.

Under the structure as such, as the driving module 620 is insertedly mounted at an inside the driving apparatus case 610 in a sliding manner and the rotational shaft 313 of the ejector 310 is insertedly coupled to the insertion groove 671 of the driving module 620, the assembly of the driving apparatus 600 is completed, and thus the assembly quality of the driving apparatus 600 may be enhanced and a single driving module 620 may be used for other refrigerators by standardizing components.

Meanwhile, the ice maker 300 may further include the drain duct 330 disposed at a lower side of the ice making tray 340, and configured to form a portion of the cooling air flow path of the ice making compartment 60 in between the ice maker 300 and the ice making tray 340, and at the same time, collect and guide the water discharged as a result of the excess supply of water at the ice making tray 340 and the defrost water of the ice making tray 340.

As previously described, the drain duct 330 may be disposed in a modestly inclined manner so that the water collected may flow to the guide unit 330 formed at one end portion of a lengthwise direction of the drain duct 330.

The drain duct 330 may be provided with an ice separating heater fixing unit 332 configured to support the ice separating heater 370 and closely attach the ice separating heater 370 to the ice separating heater contacting unit 362 of the ice making tray 340 and a refrigerant pipe fixing unit 333 configured to support the ice making compartment refrigerant pipe 57 and closely attach the ice making compartment refrigerant pipe 57 to the refrigerant pipe contacting unit 361 of the ice making tray 340, and the ice separating heater fixing unit 332 and the refrigerant pipe fixing unit 333 may be protruded toward an upper side of the drain duct 330.

The ice separating heater fixing unit 332 may be formed with the material having high thermal conductivity such as aluminum, so that the heat of the ice separating heater 370 may be guided to the drain duct 330, thereby preventing the formation of frost at the drain duct 330.

The refrigerant pipe fixing unit 333 may be composed of by including an elastic unit 334 formed with rubber material and a pressurizing unit 335 to pressurize the ice making compartment refrigerant pipe 57. The elastic unit 334 is configured to make direct contact with the ice making compartment refrigerant pipe 57 so that the ice making compartment refrigerant pipe 57 may be closely attached to the refrigerant pipe contacting unit 361 of the ice making tray 340.

The elastic unit 334 is formed with rubber material, and thus may prevent the ice making compartment refrigerant pipe 57 from being damaged at the time when the elastic unit 334 makes contact with the ice making compartment refrigerant pipe 57. In addition, as the elastic unit 334 is provided with a low thermal conductivity, the cool energy is prevented from being delivered to the elastic unit 334 from the ice making compartment refrigerant pipe 57, and thus the formation of frost at the drain duct 330 may be prevented.

Meanwhile, the automatic ice making assembly 100 may further include an ice storage space 401 configured to store the ice generated at the ice making tray 340, the ice bucket 400 having the auger 403 configured to move the stored ice to a discharging hole 402 at a front, and the auger motor assembly 500 configured to drive the auger 403 of the ice bucket 400.

The ice bucket 400 may further be provided with an ice crushing apparatus 405 configured to crush the ice moved to a front by the auger 403 and the ice making compartment cover 404 configured to cover the open front surface of the ice making compartment 60.

The ice crushing apparatus 405 includes an ice crushing blade 406 configured to crush ice by rotating along with the auger 403 and a supporting member 407 disposed at a lower side of the ice crushing blade 406 and configured to support the ice so that the ice may be crushed. The supporting member 407 may be connected to the solenoid valve 530 of the auger motor assembly 500 by the connecting member 408.

As the solenoid valve 530 is operated in upward and downward directions, the connecting member 408 eccentrically rotates, and the supporting member 507 may be moved either to support or not to support the ice.

Meanwhile, the auger motor assembly 500 may be composed of by including an auger motor 510 configured to generate rotational force, a flange 512 coupled to the auger 403 to deliver the rotational force of the auger motor 510 to the auger 403, the solenoid valve 530 capable of selecting whether ice is crushed through the ice crushing apparatus 405, an ice making compartment fan 520 capable of having the air inside the ice making compartment 60 to flow, and the drain hose 540 to guide the water guided through the guide unit 331 of the drain duct 330 to an outside the ice making compartment 60.

In particular, the auger motor assembly 500 may be integrally formed as the above components are entirely assembled together. That is, as illustrated on FIGS. 6 to 7, the auger motor assembly 500 includes an auger motor accommodating unit 511, a solenoid valve accommodating unit 531 configured to accommodate the solenoid valve 530, a drain hose accommodating unit 541 to accommodate the drain hose 540, and a fan bracket unit 521 at which the ice making compartment fan 520 is installed, and each accommodation unit may be either integrally formed or separately formed, and may be coupled to each other.

At this time, as the solenoid valve accommodating unit 531 is provided at a front of the auger motor accommodating unit 511, the solenoid valve 530 may be disposed at a front of the auger motor 510, the drain hose 540 may be disposed at one side of the auger motor 510 as the drain hose accommodating unit 541 is provided at one side of the auger motor accommodating unit 511, and the ice making compartment fan 520 may be disposed at an upper side of the auger motor 510 as the fan bracket unit 521 is provided at an upper side of the auger motor accommodating unit 511.

A portion of the drain hose accommodating unit 541 is positioned higher than the auger motor accommodating unit 511, and the fan bracket unit 521 may be coupled to an upper portion of the drain hose accommodating unit 541.

In addition, the auger motor accommodating unit 511 and the fan bracket unit 521 are provided while having a distance thereinbetween, and an air inflow space 550 may be formed between the auger motor accommodating unit 511 and the fan bracket unit 521 so that air may inflow to the ice making compartment fan 520. In addition, the ice making compartment fan 520 may be disposed at a lower side of the entry 203 of the inner flow path 202 of the air duct 200, which was described previously.

Thus, the cool air at an inside the ice making compartment 60 may flow the inside the ice making compartment 60 by following an arrow illustrated on FIG. 4. That is, the air discharged from the air duct 200 passes through the space in between the ice making tray 340 and the drain duct 330 and exchanges heat with around the an ice making compartment refrigerant pipe 57 or the ice making tray 340, and the cool air having the heat exchanged passes through the ice crushing apparatus 405 and the ice storage space 401, and then may be introduced to the air duct 200 again.

According to the flow of the cool air at an inside the ice making compartment 60 as such, the cool air may be evenly delivered to the surrounding the ice discharging hole 402 of the ice bucket 400 and the ice storage space 401.

Meanwhile, as illustrated on FIG. 7, the fan bracket unit 521 may be provided therein with a sealing member 522 to prevent the cool air from leaking. In addition, the drain hose accommodating unit 541 may be composed of by including an accommodating space 544 to accommodate the drain hose 540 and an insulation member to surround the accommodating space 544.

The entry 543 of the drain hose 540 is provided at a lower side of the guide unit 331 of the drain duct 330, which is described previously, and may receive the water freefalling from the guide unit 331 and guide the water to an ice making compartment discharging flow path 560 (FIG. 1) at an outside. The ice making compartment discharging flow path 560 is connected to an evaporation dish 570 provided at the machinery room 70, and may evaporate the water discharged.

The drain hose 540 as such may be provided with a drain heater 542 installed thereto to prevent the drain hose 540 from freezing.

In addition, the auger motor assembly 500 may include a temperature sensor 590 to measure the temperature at an inside the ice making compartment 60 and an optical sensor 580 to detect whether the ice bucket 400 is full with ice. The temperature sensor 590 and the optical sensor 580 may be provided at the solenoid valve accommodating unit 531 formed at a front of the auger motor assembly 500.

The optical sensor 580 may be either an emitter or a receiver, and the other one may be provided at the driving apparatus 600 of the ice making apparatus 300.

Meanwhile, the auger motor assembly 500 as such, as illustrated on FIG. 3, may be installed at an inside the ice making compartment 60 by being inserted thereinto in a sliding manner, and inversely, the auger motor assembly 500 may be separated by being withdrawn in a sliding manner. Thus, the components of the auger motor assembly 500, which are described previously, may be easily installed at an inside the ice making compartment 60, and a repair or a replacement of a compartment may be easily performed by separating the auger motor assembly 500 from the ice making compartment 60.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body;

a storage compartment formed at an inside the body;

an ice making compartment provided at an inside the body while being divided from the storage compartment;

a cool air supplying apparatus having a compressor, a condenser, an expansion apparatus, an evaporator, and a refrigerant pipe, at least a portion of which is disposed at an inside the ice making compartment so that a cooling energy is supplied to the ice making compartment;

an ice making tray configured to be contacted with the refrigerant pipe in the ice making compartment so that the ice making tray directly receives cooling energy from the refrigerant pipe in the ice making compartment;

an ejector rotatively disposed at an upper side of the ice making tray to separate ice from the ice making tray;

an ice bucket provided at a lower side of an ice maker to store the ice separated from the ice making tray; and a driving apparatus disposed at one longitudinal side of the ice making tray to drive the ejector and control an ice making process, wherein the driving apparatus comprises a driving apparatus case provided with an open front surface and having an inside space thereof;

a cover configured to be attached/detached on the open front surface of the driving apparatus case to open/close the open front surface of the case; and a driving module having an ice separating motor configured to generate a rotational force to rotate the ejector, a circuit board configured to control the ice making process, and a module case configured to accommodate the ice separating motor and the circuit board, wherein the driving module is configured to be inserted in a sliding manner to be mounted at the inside space of the driving apparatus case through the open front surface of the driving apparatus case, or is configured to be withdrawn in a sliding manner through the open front surface of the driving apparatus case to be separated from the inside space of the driving apparatus case.

2. The refrigerator of claim 1, wherein each of the module case and the driving apparatus case is provided with at least one coupling hole, to which a coupling member is coupled, formed thereto in order to fix the driving module at the inside space of the driving apparatus case.

3. The refrigerator of claim 2, wherein the coupling member is coupled to the coupling hole through the open front surface of the driving apparatus case.

4. The refrigerator of claim 1, wherein the driving module comprises a driving gear coupled to a rotational shaft of the ice separating motor, a driven gear coupled to a rotational shaft of the ejector, and at least one electro-motion gear coupled in between the driving gear and the driven gear in an interlocking manner.

5. The refrigerator of claim 4, wherein the electro-motion gear comprises a large-size gear configured to receive a rotational force and a small-size gear having a smaller radius compared to a radius of the large-size gear to deliver the received rotational force at a reduced speed.

6. The refrigerator of claim 4, wherein the driven gear is disposed at an outside of the module case.

7. The refrigerator of claim 4, wherein the driven gear comprises a connecting bar having an insertion groove into which the rotational shaft of the ejector is inserted, and protruded toward a direction of a shaft of the driven gear in order to rotate along with the driven gear, and the ejector is rotated along with the driven gear as the rotational shaft of the ejector is insertedly coupled to the insertion groove.

8. The refrigerator of claim 1, wherein the module case is formed with a heat insulation material.

9. A refrigerator, comprising:

a body;

a storage compartment formed at an inside the body;

an ice making compartment provided at an inside the body while being divided from the storage compartment;

a cool air supplying apparatus having a compressor, a condenser, an expansion apparatus, an evaporator, and a refrigerant pipe, at least a portion of the refrigerant pipe is disposed at an inside the ice making compartment so that a cooling energy is supplied to the ice making compartment;

an ice making tray configured to be contacted with the refrigerant pipe in the ice making compartment so that the ice making tray directly receives cooling energy from the refrigerant pipe in the ice making compartment;

an ejector rotatively disposed at an upper side of the ice making tray to separate ice from the ice making tray;

an ice bucket provided at a lower side of the ice maker to store the ice separated from the ice making tray; and a driving apparatus disposed at one longitudinal side of the ice making tray to drive the ejector and control an ice making process, wherein the driving apparatus comprises a driving apparatus case and a driving module configured to be attached/detached at an inside the driving apparatus case, the driving module comprises a module case, an ice separating motor accommodated at an inside of the module case and configured to generate a rotational force, and a plurality of gears configured to rotate while being interlocked to each other so that the rotational force of the ice separating motor is delivered to the ejector, and at least one of the plurality of gears is disposed at an outside of the module case so that the at least one gear is coupled to a rotational shaft of the ejector.

10. The refrigerator of claim 9, wherein a rotational shaft of the at least one gear disposed at the outside the module case is formed in a same line with the rotational shaft of the ejector.

11. The refrigerator of claim 9, wherein the at least one gear disposed at the outside the module case is provided with an insertion groove formed thereto so that the rotational shaft of the ejector is insertedly coupled to the insertion groove.

12. A refrigerator having an ice making compartment and a refrigerant pipe, comprising:

an ice making tray configured to contact the refrigerant pipe;

an ejector rotatively above the ice making tray to separate ice from the ice making tray;

an ice bucket below the ice maker to store the ice separated from the ice making tray; and a driving apparatus to drive the ejector, the driving apparatus including a driving apparatus case and a driving module, wherein the driving module comprises a module case, an ice separating motor accommodated at an inside the module case and a plurality of gears configured to rotate while being interlocked to each other, at least one of the plurality of gears being disposed at an outside of the module case and configured to be coupled to a rotational shaft of the ejector, the driving module being an integrated unit that is removably attachable to an inside of the driving apparatus case via a fastening member.

13. The refrigerator of claim 12, wherein a rotational shaft of the at least one gear disposed at the outside the module case is formed in a same line with the rotational shaft of the ejector.

14. The refrigerator of claim 12, wherein the at least one gear disposed at the outside the module case is provided with an insertion groove formed thereto so that the rotational shaft of the ejector is insertedly coupled to the insertion groove.

* * * * *